United States Patent [19]

Self et al.

[11] 4,391,833

[45] Jul. 5, 1983

[54] METHOD OF MAKING AND USING HEAT RESISTANT RESIN COATED PAPERBOARD PRODUCT AND PRODUCT THEREOF

[75] Inventors: Robert W. Self; Allan A. Whillock, both of Mobile, Ala.

[73] Assignee: International Paper Company, New York, N.Y.

[21] Appl. No.: 899,238

[22] Filed: Apr. 24, 1978

Related U.S. Application Data

[63] Continuation of Ser. No. 610,448, Sep. 4, 1975, abandoned.

[51] Int. Cl.[3] ..... A23L 1/00; A21B 3/15; B32D 27/10; B65D 27/10

[52] U.S. Cl. ..... 426/523; 220/458; 229/2.5 R; 229/3.1; 229/3.5 R; 426/113; 426/127; 428/35; 428/481; 428/537; 427/209; 427/211; 427/382; 427/391

[58] Field of Search ..... 426/113, 114, 106, 127, 426/132, 415, 523, 412; 229/2.5 R, 3.5 R, 3.1; 428/481, 321, 304, 482, 35, 537; 220/455, 456, 457, 458; 99/446

[56] References Cited

U.S. PATENT DOCUMENTS

| | | | |
|---|---|---|---|
| T856,008 | 11/1968 | Lawry | 426/114 |
| 2,027,296 | 1/1936 | Stuart et al. | 229/2.5 |
| 2,042,070 | 5/1936 | McCaskell | 229/2.5 |
| 2,050,061 | 8/1936 | McCaskell | 229/2.5 |
| 2,170,040 | 8/1939 | Stuart | 126/39 M |
| 2,391,767 | 12/1945 | Beerend | 220/458 |
| 3,394,388 | 7/1968 | Kuchlin | 426/127 |
| 3,423,212 | 1/1969 | Purcell et al. | 426/415 |
| 3,516,960 | 6/1970 | Martins et al. | 426/415 |
| 3,619,215 | 11/1971 | Bard et al. | 426/113 |
| 3,716,369 | 2/1973 | Perlman | 426/412 |
| 3,756,495 | 9/1973 | Bemiss | 220/458 |
| 3,821,015 | 6/1974 | Feinberg | 426/106 |
| 3,885,730 | 5/1975 | Christensson | 220/464 |
| 3,890,448 | 6/1975 | Ito | 426/106 |
| 3,924,013 | 12/1975 | Kane | 426/127 |

FOREIGN PATENT DOCUMENTS

| | | | |
|---|---|---|---|
| 479968 | 1/1952 | Canada | 426/114 |
| 2363517 | 7/1974 | Fed. Rep. of Germany | 426/113 |
| 1008679 | 11/1965 | United Kingdom | 426/128 |
| 1386635 | 3/1975 | United Kingdom | 99/446 |

OTHER PUBLICATIONS

Modern Packaging Encyclopedia, pp. 180, 181, 1950.

*Primary Examiner*—Steven L. Weinstein
*Attorney, Agent, or Firm*—Richard M. Barnes

[57] ABSTRACT

A paperboard product resistant to discoloration and otherwise stable upon heating, coated on the first surface thereof with a pigmented water impermeable layer and on the second surface thereof with a pigmented water permeable layer. The paperboard product is desirably used as the material employed in containers for food that is to be cooked in conventional or microwave ovens. The container is constructed so that the food in the container is in contact with the water impermeable layer.

17 Claims, 3 Drawing Figures

METHOD OF MAKING AND USING HEAT RESISTANT RESIN COATED PAPERBOARD PRODUCT AND PRODUCT THEREOF

This is a continuation of application Ser. No. 610,448, filed Sept. 4, 1975, now abandoned.

BACKGROUND OF THE INVENTION

This invention relates to a heat resistant paperboard product. More specifically, this invention relates to a coated heat resistant paperboard product which may be constructed into a container for food to be used in either conventional or microwave ovens.

In the past, containers for food to be cooked therein have generally been manufactured from aluminum. However, with the increasing cost of aluminum raw material and the increasing use of microwave ovens in which food material lying directly against the aluminum cannot be heated, such containers have become increasingly impractical.

In considering alternative materials for containers in which food may be cooked, several characteristics are desired. First, the part of the container which is in contact with the food should provide a good barrier to the constituents of the food such as water and grease. Second, for aesthetic reasons the container should retain its brightness upon heating. Third, the material should have little tendency to blister or explode under cooking conditions and otherwise should be stable. Additionally, the material should be suitable for cooking in both conventional and microwave ovens. Finally, the alternative material should not affect the taste of the food cooked therein.

The heat resistant paperboard product of our invention has the above characteristics and therefore, is a desirable material to be employed in containers for T.V. dinners and the like.

SUMMARY OF THE INVENTION

Broadly, the heat resistant paperboard product of our invention comprises a paperboard substrate coated on one side with an impermeable layer containing a binder and an opaque pigment, and coated on its opposite side with a water permeable layer containing a binder and an opaque pigment. According to one embodiment of our invention, the pigmented impermeable layer is applied to the paper substrate by extrusion coating while the permeable layer is applied by first dispersing the constituents into water and then applying the dispersion to the paper substrate with a puddle coater. The heat resistant paperboard product is then dried to reduce the water therein.

The heat resistant paper product of our invention may be constructed into a container for cooking all types of food in both conventional and microwave ovens. The container is constructed so that in use the food is in contact with the impermeable layer of the paperboard substrate, thereby insuring that food constituents do not seep into the paperboard. Further, as a result of the opaque, preferably white, pigment contained in the layers, the container retains much of its brightness and shows very little evidence of discoloration or scorching caused by pyrolosis and oxidation of the cellulose in the paperboard substrate. Additionally, the steam produced from the moisture present in the paperboard during cooking may escape through the permeable layer thereby avoiding blistering, puffing or exploding of the paperboard. Finally, in our preferred embodiments, the taste of food is substantially unaffected when cooked in the containers of our invention.

DESCRIPTION OF THE PREFERRED EMBODIMENTS

Figure 1:
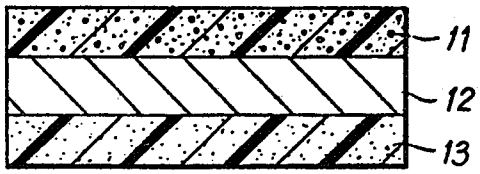
FIG. 1 shows in cross section the heat resistant paperboard of our invention.

Referring to FIG. 1, there is shown in cross section the heat resistant paperboard of our invention. More specifically, there is shown paperboard substrate 12 coated on one side by impermeable layer 11 and on its other side by permeable layer 13.

The paperboard substrate 12 of our invention may be made from any paper base stock which may be folded or formed into a container by techniques well known in the art. Since it is preferred that the containers made from our heat resistant paperboard product are white, the paper base stock is preferably bleached. The preferred base stock is bleached sulfate stock, but other types of stock, e.g., bleached sulphite may be employed. The thickness of the substrate may also be varied widely and is not critical to our invention. The substrate, of course, must be sufficiently thick to provide a container capable of holding food but not so thick that containers for food may not be made therefrom. Thickness of the substrate will be dependent on size and shape of the container, weight of the food product, etc. For example, a 0.015 inch thick paper substrate is suitable for the purposes of our invention.

The impermeable layer 11 of the invention comprises a binder containing an opaque pigment represented by the dots shown in FIG. 1. The impermeable layer must be impermeable to food constituents such as water and preferably both water and grease. Thus, containers produced from the paperboard product of our invention will permit substantially no permeation of water into its paperboard substrate when water is poured into the container at 70° F. and stored for a period of five minutes. Additionally, the most preferred containers produced from the paperboard product of our invention will permit substantially no permeation of bacon grease into its paperboard substrate when grease at 300° F. is poured into the container and stored therein at an ambient temperature of 70° F. until the grease solidifies.

The impermeable layer, of course, must be able to withstand oven temperatures, e.g., 350° F., without melting or degradation and must be capable of being applied as a layer to the paper substrate. Additionally, it is preferred that the layer be sufficiently impermeable so as to prevent the loss of aroma into the paper substrate and to prevent excessive inclusion of ambient aromas or gases into the food product. The preferred materials to be used in this aspect of our invention are polytetramethylene terephthalate (PTMT) or polycyclohexalene dimethylene terephthalate (PCDT), but other materials, e.g., polycyclohexalene dimethylene terephthalate-phthalic acid copolymer, nylon 6, nylon 66, nylon 6/66 copolymers may desirably be used. The preferred materials have good extrusion coating characteristics, and are relatively inexpensive.

The opaque pigment that is used in the impermeable layer of our invention is defined as any pigment with a refractive index greater than 1.5 and preferably greater than about 1.9. The pigment must also be able to withstand oven temperatures and be capable of being processed with the impermeable binder. The pigment must be opaque so that the container retains its brightness, which otherwise would be lost due to scorching or discoloration of the paper substrate during cooking. For aesthetic reasons, it is preferred that the pigment be white, but it is contemplated that other colors may be employed within the scope of our invention.

The most preferred opaque pigments employed in the impermeable layer of our invention are titanium dioxides of either the rutile or anatase type. With titanium dioxide pigment, the preferred particle size is 0.1 to 0.5 microns. While titanium dioxide has the highest refractive index of any white pigment of which we are aware, it is relatively expensive, and therefore it may be desired to replace titanium dioxide in whole or in part by other opaque white pigments, e.g., kaolin clay, barium sulfate, amorphous silicon dioxide, zinc oxide, zinc sulfide, calcium carbonate, calcium silicate, calcium sulfate, satin white, flux-calcined diatomaceous silica, talc, or hydrated alumina. However, for our present purposes we prefer to use titanium dioxide alone in the impermeable layer of the paper substrate.

Broadly, it is contemplated that 2.5% to 20% by weight of the impermeable pigmented layer 11 may be pigment. The most preferred range is 5% to 10% by weight pigment with 7.5% by weight the most preferred amount. Further, it is broadly contemplated that the impermeable pigmented layer be applied to the paper substrate in a thickness of from 0.0005 to 0.002 inches, with the most preferred range being from 0.00075 to 0.001 inches.

It should be stressed, however, that the amounts of pigment and layer thickness may be varied widely both within and without the above ranges. If greater brightness retention is desired, the concentration of pigment or the thickness of the layer may be increased or, alternatively, if the product stored in the container requires low cooking temperature, or time, the concentration of pigment or the thickness of the layer may be decreased. It is therefore contemplated that a wide variety of impermeable layers may be provided according to the present invention.

The permeable layer 13 comprises at least a binder with an opaque pigment dispersed therein. The opaque pigment is represented by the dots in FIG. 1. Permeable layer 13 must be sufficiently permeable to permit the escape of steam which is vaporized from the paperboard substrate during heating. Whether a particular layer is permeable is readily determined since products that are coated with layers that are not permeable will puff and blister when placed in an oven heated to 350° F. for 15 minutes.

The permeable layer in our invention must also be able to withstand oven temperatures, e.g., 350° F., without degradation and must be capable of being applied as a coating to the paperboard substrate.

The preferred binders employed in the permeable layer are polymeric binders. The most preferred binder is polyvinyl acetate but other binders such as polyvinyl alcohol or styrene butadiene may be employed. Polyvinyl acetate is preferred because it is easily coated onto the paper and does not darken excessively at high temperatures.

The opaque pigments that are employed in the permeable layer 13 of our invention are governed essentially by the same considerations described above for the impermeable layer 11. An opaque pigment is defined as any pigment with a refractive index greater than 1.5 and preferably is white in color. However, since aesthetic considerations are met by a mixture of less costly pigments having a refractive index greater than 1.5 but less than 1.9 with more costly pigments having a refractive index above 1.9, it is preferred that the opaque pigment in the permeable layer of our invention comprise a mixture of titanium dioxide and kaolin clay.

In addition to the binder and opaque pigment, other constituents may also be employed in our permeable layer. As will be described in more detail below, the binder and pigment of the permeable layer are preferably first slurried in water and applied as a slurry to the paper substrate. In order to aid dispersion of the suspended pigment particles in the slurry, tetra sodium pyrophosphate, sodium hexametaphosphate, or commercial anionic polyelectrolytes such as Tamol 850, produced by Rohm and Haas, Dispex N-40 produced by Allied Colloids, Number 111 produced by Colloids, Inc., or Daxad 30 produced by W. R. Grace Co. may be employed. The preferred dispersants are dispersing agents such as tetra sodium pyrophosphate and Tamol 850, a sodium salt of a carboxylated polyelectrolyte, or mixtures thereof. The amount of dispersant may be varied widely, but is preferably about 0.1 to 0.17% by weight of the pigment.

Once the slurry is applied to the paperboard substrate it is often desired to meter off excess coating with application equipment. In order to retain enough water within the coating film during the time interval between application and metering off and to prevent coating streaks during metering off, we prefer to add to the slurry small amounts of viscosity control agents such as sodium alginate. Other viscosity control agents that may be used for this purpose include sodium carboxymethyl cellulose sodium polyacrylate emulsions, and hydroxyethyl cellulose. Again, the amount of viscosity control agent may be varied widely, but the amount is preferably between about 0.2 to 0.4% by weight of the pigment.

As will be described in more detail below, after the desired amount of permeable layer has been applied to the paperboard substrate, the composite is dried and preferably calendered and gloss calendered. In order that the composite may be more easily calendered, it is desirable to enhance the plasticity and slipperiness of the applied permeable layer. To accomplish this end, small amounts of a lubricant, e.g., calcium stearate, are preferably added to the coating slurry. Other well known lubricants, which may replace calcium stearate, in whole or in part, include polyoxethylated ethers, zinc stearate, alkoxylated triols, polyethylene emulsion, polyoxyethylene ether, ammonium stearate, polyalkylene glycol derivatives and mixtures thereof. The amount of lubricant may be varied widely, but preferably is between about 0.1 and 2% by weight of the pigment.

It may sometimes be desired to print with ink the permeable layer of our invention. As is appreciated by those skilled in the art, many offset printing inks require longer drying times on acid coatings than on alkaline coatings. However, if the coating is too alkaline, good ink coverage may be impeded under certain offset printing conditions. It is therefore broadly preferred that the pH of layer 13 be between 7.0 and 10.5 at room temperature. The preferred pH range is 8.5 to 9.2, with 9.0 being the most preferred pH. To establish the preferred pH values it is sometimes required that an alkaline material be added to the water slurry of permeable layer material in amounts sufficient to raise the pH to the range of 7.0 to 10.5. The preferred alkaline material is ammonium hydroxide, but sodium or potassium hydroxide can also be used.

The concentration of the constituents and the thickness of the applied permeable layer may be varied widely by those skilled in the art for the same reasons that the same parameters can be widely varied for the impermeable layer. The permeable layer preferably is applied to the substrate layer 12 at a loading of from 8 lbs. to 30 lbs. per 3000 sq. ft. and more preferably is from 17 lbs. to 23 lbs. per 3000 sq. ft. Further, the amounts of constituents by weight are preferably varied as shown in Tables 1 to 5 below:

TABLE 1

| Component | broad range | narrow range | preferred amount |
|---|---|---|---|
| Opaque pigment | 100 | 100 | 100 |
| Permeable binder | 10–30 | 18–22 | 20 |

TABLE 2

| Component | broad range | narrow range | preferred amount |
|---|---|---|---|
| Titanium dioxide | 15–80 | 30–50 | 45 |
| Kaolin clay | 20–85 | 50–70 | 55 |
| Polyvinyl acetate | 10–30 | 18–22 | 20 |

TABLE 3

| Component | broad range | narrow range | preferred amount |
|---|---|---|---|
| Opaque pigment | 100 | 100 | 100 |
| Permeable binder | 12–30 | 18–22 | 20 |
| Viscosity control agent | .05–.5 | .2–.4 | .33 |
| Dispersant | .02–.30 | .10–.17 | .14 |
| Lubricant | 0–3.0 | .5–1.5 | 1.0 |

TABLE 4

| Component | broad range | narrow range | preferred amount |
|---|---|---|---|
| Titanium dioxide | 15–80 | 30–50 | 45 |
| Kaolin clay | 20–85 | 50–70 | 55 |
| polyvinyl acetate | 12–30 | 18–22 | 20 |
| viscosity control agent | .05–.5 | .2–.4 | 0.33 |
| Dispersant | .02–.30 | .10–.17 | .14 |
| Lubricant | 0–3.0 | .5–1.5 | 1.0 |

TABLE 5

| Component | broad range | narrow range | preferred amount |
|---|---|---|---|
| Titanium dioxide | 15–80 | 30–50 | 45 |
| Kaolin clay | 20–85 | 50–70 | 55 |
| Polyvinyl acetate | 12–30 | 18–44 | 20 |
| Sodium alginate | .05–.5 | .2–.4 | 0.33 |
| Tamol 850 | .01–.15 | .07–.11 | 0.09 |
| Tetra sodium pyrophosphate | .01–.15 | .03–.07 | 0.05 |
| Calcium stearate | 0–3 | .5–1.5 | 1.0 |
| Alkali | In amounts as needed to maintain pH of water slurry. | | |

One way of defining layers 11 and 13 of our paperboard product is by measuring the brightness of the heat resistant paperboard product upon exposure to heat. The brightness of the heat resistant paperboard products of our invention have been measured with a General Electric Brightness Meter by conventional technique after heating two inch squares in a conventional oven at 400° F. for 30 minutes. We have found that the side coated with the permeable layer maintained a brightness above 70% and preferably above 75% while samples of uncoated paperboard maintained a brightness of below 50% under similar conditions. The side coated with the impermeable layer maintained a brightness above 50% while samples with conventional polyethylene or polypropylene polymer coatings maintained a brightness below 30%.

Figure 2:
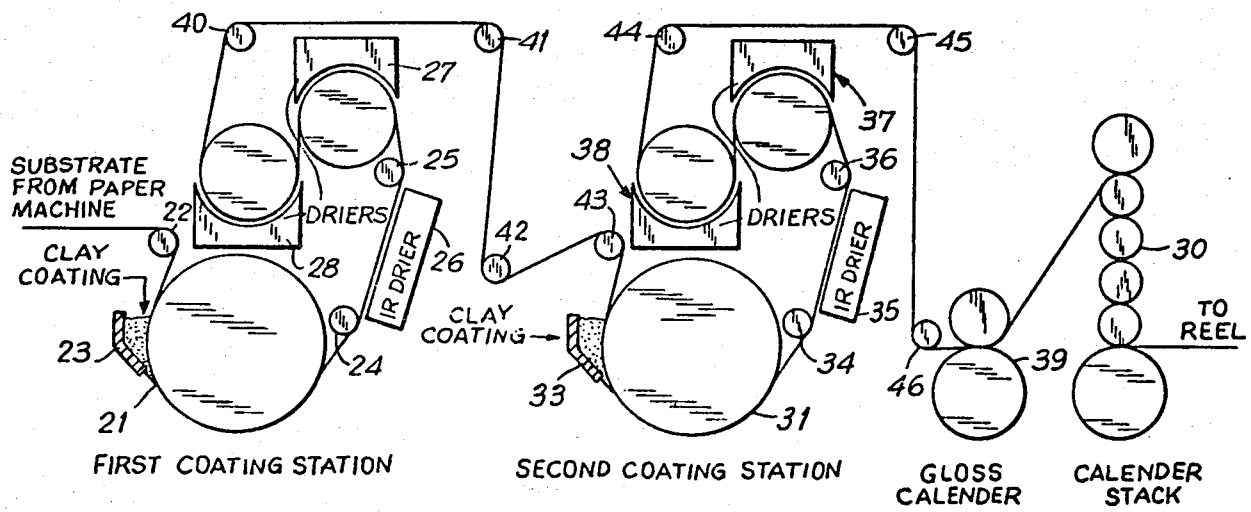
FIG. 2 shows a flow sheet of the preferred process by which the permeable coating is applied to the paperboard substrate.

Referring now to FIG. 2, there is shown a schematic flow sheet of the preferred process by which the permeable layer 13 is affixed to the paperboard substrate. As shown in FIG. 2 a substrate of paper is supplied to a first coating station 21 via roller 22. At the first coating station an aqueous slurry of the water permeable coating is applied to the paper substrate by conventional means such as puddle coater 23. Other conventional means by which the aqueous slurry of water permeable coating may be applied include flooded nip trailing blade coaters, rod coaters, reverse roll coaters, Massey coaters, air knife coaters and Chamflex coaters. In order to maintain drying costs, the amount of water in the slurry is desirably maintained at the minimum amount required to maintain the mixture as a slurry. While the amount of water will vary somewhat depending on the water permeable coating formulation and application method, it is generally preferred to employ about 0.54 to 1.0 parts by weight water per 1 part by weight of water permeable coating mixture. In practice, the water permeable coating mixture is dispersed in water in an agitated tank.

After the wet coating is applied to the paper substrate in first coating station 21, the applied water must be evaporated therefrom. As shown in FIG. 2, this is accomplished by passing the coated paperboard substrate via roller 24 through infra red drier 26 and then via roller 25 through two hot air driers 27 and 28 in series. It will be appreciated, however, that any type of drier or combination of driers may be employed and that the arrangement shown in FIG. 2 is for purposes of illustration only.

The temperatures and forced air velocities in the driers are maintained to remove water added to the paperboard substrate by the coating slurry and to obtain a product with a moisture level of 3% to 10% water by weight.

Next, in our preferred embodiment, the coating process is repeated by passing the once coated paperboard substrate through a second coating station 31 containing a second puddle coater 33. After coating, the twice coated substrate is passed through a second drying system which, for purposes of illustration, is shown as infra-red drier 35 fed by roller 34 and two hot air driers 37 and 38 in series fed by roller 36.

Again the temperatures and forced air velocities in the driers are maintained to remove water added to the paperboard substrate by the coating slurry and to obtain a product with a moisture level between 3% and 10% water by weight.

Two coating stations are employed in the preferred process since at time it is difficult to control the thicker wet coating which would be required if only a single stage were employed. However, it is to be understood that the permeable layer 13 may be applied in any number of stages.

After the second coating has been dried, the coated substrate may optionally be passed via rolls 44 to 46 to a conventional gloss calender 39 wherein by application of pressure and heat, e.g., 200° to 350° F. and preferably 250°-300° F., the coated product is glossed by the smooth polished surface of the gloss calender. Finally, the glossed coated paper substrate is optionally passed through a conventional calender stack 30 wherein through pressure imposed by opposing cylinders the product is smoothed and maintained at uniform thickness.

Figure 3:
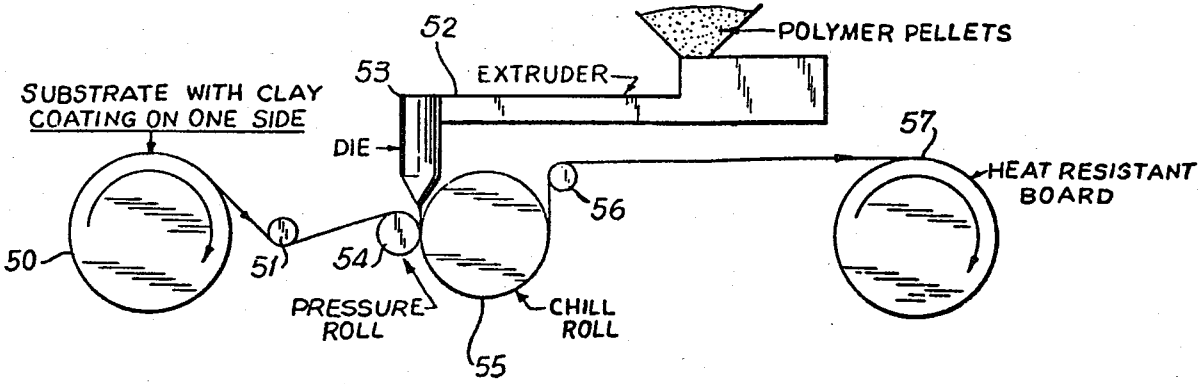
FIG. 3 shows a flow sheet of the preferred process by which the impermeable coating is applied to the paperboard substrate.

Referring now to FIG. 3, there is shown a schematic flow sheet of the preferred process for affixing the impermeable layer 11 to the paperboard substrate. It is preferred that the paperboard substrate supplied via supply roll 50 and roll 51 be already coated on one side with permeable layer 13. The reason for this is that we prefer to produce the paper substrate in combination with coating the substrate with the permeable layer. Thus, the substrate introduced via roll 22 in FIG. 2 comes directly from the paper machine for producing the paper substrate. It is to be understood, however, that there is nothing critical in the order of coating and that the impermeable layer may be applied prior to the application of the permeable layer.

The polymer-pigment mixture which is used for the impermeable layer is preferably blended and then pelletized by the polymer manufacturer. Alternatively, a polymer-pigment concentrate is prepared by the polymer manufacturer or a processor and then the concentrate pellets are blended with natural polymer pellets to produce the impermeable mixture.

The impermeable layer mixture is preferably applied to the paperboard substrate by a conventional process such as extrusion coating. Referring again to FIG. 3 there is shown extruder 52 with die 53 arranged and constructed so that the impermeable layer mixture is applied by extrusion coating onto the paperboard substrate and is then passed through pressure roll 54 and chill roll 55. For a polytetramethylene terephthalate-titanium dioxide mixture, the chill roll is preferably maintained at about 60° F. to 100° F. The functions of the chill roll are: (1) to form a nip with the pressure roll for joining the paperboard substrate and the molten polymer layer under pressure, (2) to remove heat from the impermeable layer and the paperboard substrate, and (3) to impart the desired surface finish to the impermeable layer. Preferably the nip pressure applied to the coated substrate by chill roll 55 and pressure roll 54 is about 50 to 350 lb. per linear inch of web width. Finally, the heat resistant board product is passed from the chill roll 55 via roll 56 to storage roll 57.

The following example is provided to further illustrate the invention.

EXAMPLE

A mixture was prepared by dispersing into 77 parts water, 0.14 parts Tamol 850, 0.06 parts tetra sodium pryophosphate, 45 parts titanium dioxide, 55 parts Kaolin clay, 1 part calcium stearate, 20 parts polyvinyl acetate, a sufficient amount of alkali to maintain the pH at 9.0, and 0.29 parts sodium alginate, all parts by weight. The dispersed mixture was then applied to 0.015 inch thick bleached sulfate paperboard in two stages to obtain a permeable layer coated onto the paper in the amount of 20.9 lbs. per 3000 sq. ft. About equal amounts of coating were applied in each stage.

Next, the paperboard substrate was extrusion coated on its other side as described above in connection with FIG. 3, with a polymer mixture of 92.5 parts by weight polytetramethylene terephthalate and 7.5 parts by weight titanium dioxide. The thickness of the applied coating was 0.001 inches, the temperature of the chill roll was 70° F., and the applied pressure was 150 pounds per lineal inch of web width.

The resulting coated product could be formed into containers for food by conventional techniques and was impermeable to water and grease on one side but yet permeable to water on the other side. The initial G.E. brightness was 88.6% on the permeable side and 84.2% on the impermeable side, while the average G.E. brightness after heating a two inch square piece of coated product at 400° F. for 30 minutes was 77.1% on the permeable side and 55.0% on the impermeable side.

From the above example, it is apparent that there are obtained coated paperboard substrates which may be formed into containers for food by conventional techniques. The resulting containers are impermeable to food constituents on the inside surface thereof. Further, the containers do not blister or explode but do retain their brightness upon heating. It is to be understood, however, that while the invention has been described with respect to preferred embodiments, variations and equivalents thereof may be perceived by those skilled in the art while nevertheless not departing from the scope of our invention as described by the claims appended hereto.

What is claimed is:

1. A paperboard product comprising:

(a) a paperboard substrate having affixed to its first surface a water impermeable layer, said water impermeable layer comprising a binder with opaque pigment dispersed therein; and (b) a continuous water permeable layer affixed to the second surface of said paperboard substrate, said water permeable layer comprising a binder with opaque pigment dispersed therein, said paperboard product characterized by the facts that (i) it retains a brightness of at least 70% on its permeable side and at least 50% on its impermeable side after exposure to 400° F. for 30 minutes, and (ii) it will not puff or blister when placed in an oven heated to 350° F. for 15 minutes.

2. The product of claim 1 wherein the pigment in the impermeable layer comprises titanium dioxide.

3. The product of claim 1 wherein the pigment in the permeable layer comprises a mixture of titanium dioxide and kaolin clay.

4. The product of claim 1 wherein the impermeable layer binder comprises polytetramethylene terephthalate, polycyclohexalene dimethylene terephthalate or polycyclohexalene dimethylene terephthalate-phthalic acid copolymer.

5. The product of claim 4 wherein the permeable layer binder comprises polyvinyl acetate.

6. The product of claim 1 wherein the impermeable layer comprises from about 2.5% to about 20% by weight titanium dioxide and the permeable layer comprises about 15 to 80 parts by weight titanium dioxide, about 20 to 85 parts by weight kaolin clay and about 10 to 30 parts by weight polyvinyl acetate.

7. The product of claim 1 wherein the water impermeable layer is also grease impermeable.

8. The product of claim 1 wherein the product has a water content of about 3% to about 10% by weight.

9. A paperboard container for cooking food comprising a coated paperboard substrate formed into the shape of a container, said container comprising:

(a) an inside surface comprising a water impermeable layer affixed to said paperboard substrate, said water impermeable layer comprising a binder with opaque pigment dispersed therein; and (b) an outside surface comprising a continuous water permeable layer affixed to said paperboard substrate, said water permeable layer comprising a binder with opaque pigment dispersed therein, said paperboard container being characterized by the facts that (i) it retains a brightness of at least 70% on its permeable side and at least 50% on its impermeable side after exposure to 400° F. for 30 minutes; and (ii) it will not puff or blister when placed in an oven heated to 350° F. for 15 minutes.

10. A process for cooking food in a paperboard container comprising heating food in the container defined by claim 9.

11. A paperboard container for cooking food comprising a coated paperboard substrate formed into the shape of a container, said container comprising:

(a) an inside surface comprising a water and grease impermeable layer affixed to said paperboard substrate, said water and grease impermeable layer comprising a binder with opaque white pigment dispersed therein; and (b) an outside surface comprising a continuous water permeable layer affixed to said paperboard substrate, said water permeable layer comprising a binder with opaque white pigment dispersed therein, said paperboard container being characterized by the facts that (i) it retains a brightness of at least 70% on its permeable side and at least 50% on its impermeable side after exposure to 400° F. for 30 minutes; and (ii) it will not puff or blister when placed in an oven heated to 350° F. for 15 minutes.

12. The container of claim 11 wherein the impermeable layer comprises titanium dioxide and polytetramethylene terephthalate and the permeable layer comprises polyvinylacetate, titanium dioxide and kaolin clay.

13. The container of claim 11 wherein the container has a water content of about 3% to about 10% by weight.

14. A process for producing a paperboard product comprising:

(a) affixing a continuous water permeable layer comprising a mixture of binder and opaque pigment to a first surface of a paperboard substrate; and (b) affixing a water impermeable layer comprising a binder and opaque pigment to a second surface of said paperboard substrate.

15. The process of claim 14 wherein the water impermeable layer is affixed onto the second surface of the paper substrate by extruding the impermeable mixture onto the second surface and then chilling the coated substrate to harden and set the impermeable layer extruded thereon.

16. The process of claim 14 wherein the permeable layer is affixed to the paperboard substrate by first coating an aqueous slurry of the permeable layer onto the paperboard substrate and then drying the coated substrate.

17. The process of claim 16 wherein after the permeable layer is dried a second coating of aqueous slurry is coated onto the once coated substrate and subsequently dried.

* * * * *

UNITED STATES PATENT AND TRADEMARK OFFICE

CERTIFICATE OF CORRECTION

PATENT NO. : 4,391,833

DATED : July 5, 1983

INVENTOR(S) : Self et al

It is certified that error appears in the above—identified patent and that said Letters Patent is hereby corrected as shown below:

Col. 4, line 42, After "cellulose" there should be --,--

Col. 6, line 68, "time" should be --times--

Col. 10, line 9, "polyvinylacetate" should be --polyvinyl acetate--

Signed and Sealed this

*Twelfth* Day of *June 1984*

[SEAL]

*Attest:*

GERALD J. MOSSINGHOFF

*Attesting Officer*

*Commissioner of Patents and Trademarks*